US005483915A

United States Patent [19]

Clark

[11] Patent Number: 5,483,915

[45] Date of Patent: Jan. 16, 1996

[54] SNAP EXTENDER FOR A BOAT CANVAS

[76] Inventor: Ron Clark, 150 St. Marks Pl., Massapequa, N.Y. 11758

[21] Appl. No.: 409,529

[22] Filed: Mar. 24, 1995

[51] Int. Cl.[6] ..... B63B 17/00

[52] U.S. Cl. ..... 114/361

[58] Field of Search ..... 114/362, 343, 114/361; 135/88, 87, 119; 24/300, 301, 302

[56] References Cited

U.S. PATENT DOCUMENTS 586,139 7/1897 Moss ..... 24/301
1,083,573 1/1914 Wehrwein ..... 24/302
3,106,218 10/1963 Wright ..... 114/361
3,112,491 12/1963 Cleveland ..... 24/300

*Primary Examiner*—Stephen Avila

[57] ABSTRACT

A method of attaching over the central passenger opening of a boat using interconnecting male and female snaps of a boat side gunnels and a cooperating canvas that typically has shrunk out-of-fit, the supplementing use of attached strips on opposite sides of the shrunken canvas area that extend the reach of snaps that otherwise cannot be interconnected, each strip having at opposite ends a male and female snap for this purpose, so that in attaching the canvas, its central location is maintained to obviate twisting and pulling stresses or the like in the canvas.

1 Claim, 1 Drawing Sheet

SNAP EXTENDER FOR A BOAT CANVAS

The present invention relates generally to improvements for a boat canvas, and more particularly to improvements for making size adjustments in the canvas to contribute to its facilitated attachment in snapped covering relation over the passenger compartment of the boat, when the boat is in storage or otherwise not in use.

EXAMPLES OF THE PRIOR ART

It is already well known, as exemplified by U.S. Pat. No. 586,139 issued to Moss on Jul. 13, 1897 for a "Glove Attachment" to use in an interposed position between cooperating main female and male snaps that do not reach each other, a small strip having at opposite ends auxiliary female and male snaps that snap to the main snaps and in this manner close the gap between the main snaps. This technique employed by Moss is used in the fitting of a glove, and a similar technique also confined to the fitting of garments is disclosed in U.S. Pat. No. 3,112,491 issued to Cleveland on Dec. 3, 1963 for "Connection Device for Garments" (i.e. a shirt collar), and disclosed in U.S. Pat. No. 1,083,573 issued to Wehrwein on Jan. 6, 1914 for a "shoe", to mention but a few. In the above, and all known instances, the wearer of the garment due to increased size undoubtedly due to weight gain causes the separation or gap between the main snaps, and one auxiliary strip with snaps bridged across the gap is an effective solution.

In proper care and maintenance of a boat, when the boat is not in use, a canvas is typically snapped over the passenger compartment or opening of the boat to serve as a weather barrier. Typically the effect of the weather on the canvas will cause varying extents of shrinkage in varying locations, all to the end of causing non-alignment between the snaps. This non-alignment may take the form of the canvas-attached snap moving out of adjacent position, i.e. up or down in relation to a boat-attached snap, or no longer reaching the boat-attached snap, the latter being akin to the gapping in a garment, although in reverse because with a garment the size change is manifested by a size change in the wearer, and with a boat the size change is manifested by size decrease in the canvas component. Undoubtedly, the above-noted and other differ-ences in circumstances have led away from using the prior art technique of the noted patents to solve the boat canvas shrinkage problem, and thus it is the common practice in solving this problem to relocate or add additional snaps on the boat to solve "adjacent position" misalignment, or to relocate or add additional snaps nearer to the canvas peripheral edge to solve a "gapping" misalignment.

Broadly, it is an object of the present invention to maintain proper fit of a shrunken boat canvas overcoming the foregoing and other shortcomings of the prior art.

More particularly, it is an object to apply size-adjusting auxiliary strips with snaps to the boat canvas preparatory to the placement of the shrunken canvas in its operative weather barrier position over the boat opening that accounts for the shrinkage and also obviates any pulling stresses in the canvas that might cause tearing or that might remove a desirable smooth surface tautness in the canvas that facilitates rain run-off or otherwise detract from the weather-barrier functioning of the canvas.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
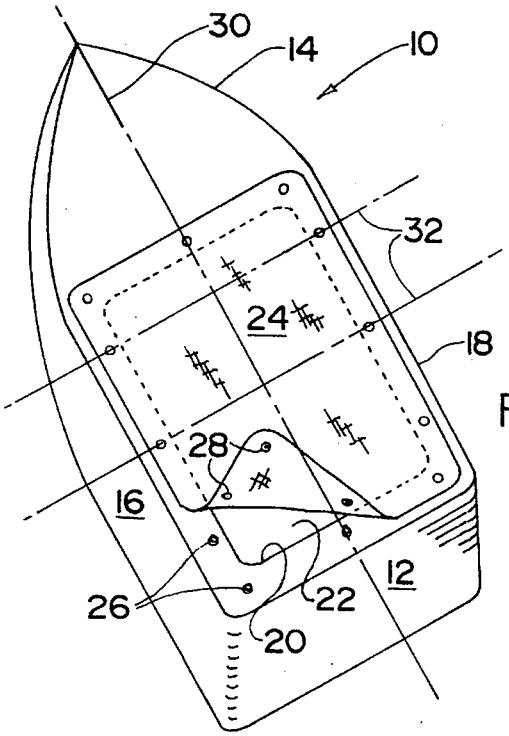
FIG. 1 is a perspective view of a boat equipped with a weather barrier canvas.
Figure 2:
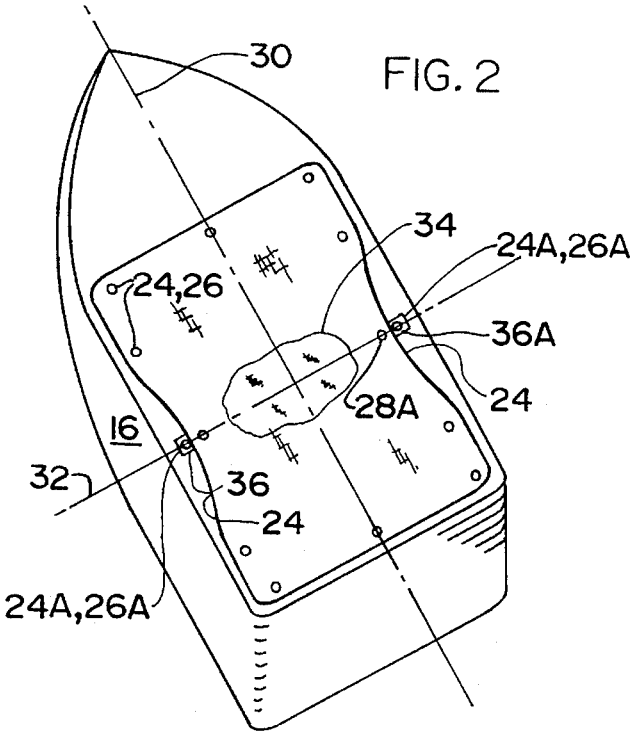
FIG. 2 is like FIG. 1, also a perspective view of a boat but illustrating attached thereto a canvas that has shrunk out-of-fit.
Figure 4:
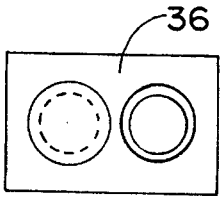
FIG. 4 is an isolated plan view of the accessory of FIG. 3.
Figure 5:
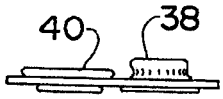
FIG. 5 is a side elevational view projected from FIG. 4 showing further details of the FIG. 3-illustrated accessory.

Illustrated in FIGS. 1, 2 is a boat, generally designated 10, simplified because not necessary to an understanding of the present invention, of a showing of an outboard motor or other powering means that is typically supported in an appropriate manner on the stern 12 of the boat. Boat 10 is of the type having a bow 14 and gunnels or opposite side walls 16 and 18 which cooperate in providing an inboard-facing wall 20 which bounds an opening 22 used by one or more boat passengers.

When not in use, a weather barrier canvas 24 is snapped in place in covering relation over the passenger compartment or opening 22 using boat-attached male snaps, individually and collectively designated 26, and canvas-attached female snaps, individually and collectively designated 28. The desired position of the canvas 24 is one in which, as best illustrated in FIG. 1, it is oriented centrally of the boat opening 22, a position herein denoted by the reference line 30. The centrally located canvas position 30 is achieved by locating the canvas-attached female snaps 28 and the boat-attached male snaps 26 at positions, denoted herein by the exemplary reference lines., individually and collectively designated 32, which align cooperating sets of the snaps 26, 28 with each other preparatory to snapping the canvas 24 in place.

As typically occurs, the effect of the weather on the canvas 24 results in shrinkage of canvas areas, such as area 34, and this in turn is manifested by the canvas shrinking out-of-fit. Stated otherwise, the cooperating canvas snap 28A does not reach the boat snap 26A along the peripheral canvas edge length portion 24A affected by the shrunken canvas area 34.

Figure 3:
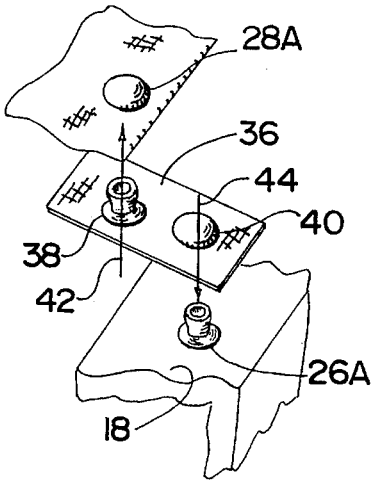
FIG. 3 is a partial perspective view of a boat-attached male snap and a canvas-attached female snap and an accessory to be used in accordance with the present invention facilitating the snapping together of the snaps.

In accordance with the present invention, the condition noted is effectively remedied while at the same time maintaining the important canvas centrally oriented position 30. More particularly, the shrunken canvas 24 is prepared for positioning over the boat opening 22 using two strips 36, 36A of rectangular shape and nominal length each having a male snap 38 and a female snap 40 at opposite strip ends in directionally opposite facing relation to each, as noted by the arrows 42 and 44. As best shown in FIGS. 2, 3 the strip male snap 38 is readily interconnected to the canvas female snap 28A at canvas peripheral edge, on both sides of the shrunken area 34, so as to have oppositely extending two canvas-attached strips 36 and 36A in aligned relation with each other. The two strip female snaps 40 thus extend the reach or span of the canvas shrunken area 34 to make up for the amount of shrinkage of area 34, and are readily interconnected to the male snaps 26A. In the FIG. 2 illustrated canvas attached position over the boat opening 22 there is a combination of interconnected sets of snaps 24 and 26 in the normal manner, and also an interconnected set of snaps 24A and 26A using the strips 36, all to the end of contributing to the canvas 24 effectively serving as a weather barrier for the boat in a centrally oriented position that does induce pulling stresses or like forces in the canvas as might otherwise occur and cause tearing of the canvas if its position was off-center.

For completeness sake it is noted that the preferred embodiment of the strips 36 contemplates use of a non-stretch construction material so as to obviate inducing any stresses in the canvas as above noted. A fabric, leather or like construction material is appropriate.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein :shown other than as defined in the appended claims.

What is claimed is:

1. A method of positioning in a longitudinally centered operative position in covering relation over a boat opening a canvas which has shrunk out of fit in relation to said boat opening and is of a type having spaced-apart plural female snaps in a peripheral edge of said canvas adapted to interconnect with cooperating spaced-apart plural male snaps in a peripheral edge bounding said boat opening, said canvas-positioning method comprising the steps of fabricating plural lengths of strips of rectangular shape each having a male snap and a female snap at opposite strip ends in directionally opposite facing relation to each other, interconnecting transversely aligned sets of canvas female snaps on canvas areas which have not shrunk out of fit to boat male snaps and in any canvas area which has shrunk out of fit interconnecting at each opposite edge location thereof one said strip male snap to a canvas female snap so as to have oppositely extending therefrom two canvas-attached strips in aligned relation to each other, and interconnecting said female snaps of said aligning two canvas-connected strips to two cooperating male snaps on said boat, whereby the lengths of said strips are effective in increasing the span of said shrunk canvas area to complete the interconnection of said cooperating snaps and in positioning the shrunk canvas area therebetween in a longitudinally centered orientation in its covering relation over said boat opening.

* * * * *